United States Patent [19]

Jansz

[11] 3,975,918

[45] Aug. 24, 1976

[54] PILEDRIVING

[75] Inventor: Joost Werner Jansz, The Hague, Netherlands

[73] Assignee: Hollandsche Beton Groep N.V., Rijswijk, Netherlands

[22] Filed: Mar. 28, 1975

[21] Appl. No.: 563,206

[30] Foreign Application Priority Data

Apr. 5, 1974 United Kingdom ..... 15179/74

[52] U.S. Cl. ..... 61/53.5; 173/DIG. 2; 181/36 R; 181/36 A

[51] Int. Cl.[2] ..... E02D 7/02; F01N 3/06

[58] Field of Search ..... 61/53.5, 53; 173/DIG. 2; 181/36 R, 36 A

[56] References Cited

UNITED STATES PATENTS

| | | | |
|---|---|---|---|
| 2,122,517 | 7/1938 | Curtis | 181/36 A |
| 3,667,571 | 6/1972 | Fattelay | 173/DIG. 2 |
| 3,757,891 | 9/1973 | Krieger | 181/36 A X |

*Primary Examiner*—Jacob Shapiro
*Attorney, Agent, or Firm*—Brisebois & Kruger

[57] ABSTRACT

Noise radiated into the atmosphere from a pile during pile-driving is inhibited by a tubular cover of flexible material having internal dimensions sufficient to pass, with an intervening air space, over a pile to be driven and an extended length sufficient to enclose a pile over its entire length, said cover being suspended from a hammer driving unit or a pile cap and being axially collapsible to reduce its length as the hammer driving unit or pile cap moves downwards while a pile enclosed in the cover is being driven into the ground.

15 Claims, 10 Drawing Figures

PILEDRIVING

Piledriving in general is a noisy procedure. In all cases where the piledriving operation is based upon the principle that the pile to be driven into the ground is hit by the hammer of the moving part of the piledriving apparatus, whether free-falling under gravity or accelerated under additional downward force and regardless of the driving medium, steam, air, hydraulic, diesel, there always is one major source of sound that dominates all other sounds. It is where the impact of the hammer is delivered to the pile cap. The force of the impact apart from causing radiation of soundwaves directly into the surrounding air, is also transmitted to other parts of the piledriving apparatus and to the pile which are also caused to vibrate and radiate sound waves.

Firstly it should be stated that whatever steps be taken to reduce the noise nuisance, the efficiency of the piledriving itself should in no way be affected. In piledriving this means that the impact at the moment when the hammer or ram hits the pile cap, and thus the head of the pile, must not be influenced in any negative way. The forces and energies exerted on the pile during impact are vitally essential to ensure optimal penetration. Any interposition of flexible material with cushioning properties consumes part of the energy, which part is therefore not available for driving the pile and causing its penetration into the soil.

In order to maintain the full piledriving forces during impact, it must therefore by accepted that the striking head of the hammer must directly hit the pile cap, thereby forming a source of soundradiation of great energy. This soundradiation propagates through the material of the hammer itself, the pile cap, the guide column or lead (if any) along which the hammer is led, as well as the pile itself. Moreover, the air is brought into radiation thus transmitting part of the noise energy freely through space.

Soundwaves radiated from the hammer may be insulated from a housing in which the hammer is enclosed by supporting the hammer mechanism from the housing through the intermediary of resilient means. The air inside the housing which is also brought into vibration by the hammer vibration at the moment of impact can easily be sound insulated from the housing with known means. Thereby the transmission of noise into the ambient air from the hammer vibration is reduced. The lead along which the hammer housing is guided is not brought into intense vibration because the hammer housing itself is already freed as much as possible from vibration. Additionally, if desired, resilient or flexible material can be incorporated in the shoes which connect the hammer housing to the lead to further reduce sound transfer to the lead. Direct radiation of sound from the zone where the striking head of the hammer hits the anvil of the pile cap may be inhibited by surrounding this zone by a ring of resilient material. Emission of sound from the pile cap to the surrounding air and transmission of soundwaves to the lead may be reduced by surrounding the pile cap proper by a casing, with resilient material interposed between the cap and the casing, the latter being connected to the lead.

The precautions described to keep the level of sound as low as possible do not inhibit the pile itself from being given a maximum of force and energy at every blow in order to ensure good penetration. However, the pile itself acts as a source of sound, the intensity of which depends on its length above the ground, its dimensions and its material. Relatively short concrete piles may in some cases have sufficient dampening properties of their own to provide sufficiently low decibel values when driven by a noise reducing hammer and pile cap arrangement as above referred to. Steel piles however generally produce noise levels during driving that are greater in magnitude than the relatively quiet hammer and pile cap arrangement referred to. Additional sound insulation of the pile itself is, in certain cases, necessary or desirable.

There are known constructions to solve this problem. All these in common employ a sound insulated hood or cover which extends from top of the guide column to the soil surface and by which the pile in its full undriven length, with the hammer and the pile cap on top of it, is surrounded. As most existing hammers have open exhaust systems where gases (diesel hammers), steam (steam hammers) or air (air-operated hammers) must be exhausted at the end of every successive blow, such hoods or covers must generally be open at the top. Further, in order to be workable, the hood or cover must be capable of being opened lengthwise and of both parts being hinged aside, to enable a new pile to be brought into position. In practice it is difficult completely to close the hood or cover its full length. Besides the connection between the hood or cover and the soil surface can in most cases only be effected by means of flexible sheeting. For these reasons, such hoods or covers necessarily need an internal surface of a material which absorbs as much sound as possible. Other disadvantages of this type of construction are its considerable weight, as well as its dimensions, the former necessitating the use of heavier cranes or even a second crane to handle the cover construction and the latter influencing the stability of the crane, especially so when the cover is opened and provides a large surface area upon which the wind can act. In opened condition the two lengthwise halves of the cover must be hinged far enough back to prevent them from being touched or damaged by a new pile during its insertion into position. It is clear that such bulky constructions increase the time required for inserting and driving a pile and consequently upon the economics of pile driving.

The object of the invention is to provide an improved method and apparatus for reducing the noise emitted from the pile itself. Another object is to provide a pile driving apparatus wherein noise is reduced not only from the pile but also from the hammer, the pile cap and the lead.

SUMMARY OF THE INVENTION.

Briefly stated, the invention reduces noise radiated from a pile on impact by a hammer or ram by means of a tubular cover of flexible material having internal dimensions sufficient to pass over the pile to be driven, said cover preferably being supported at its upper end by the hammer unit or pile cap and being extensible to enclose the pile over its entire length, the cover collapsing or folding up to reduce its length as the pile is driven into the ground.

The cover is conveniently formed with a bellows-like or concertina-like construction so that it can be collapsed or folded up into a relatively short length in the fully retracted condition compared with its extended length. When so retracted the cover preferably surrounds a skirt portion of the pile cap which protects the cover from contact with and damage by the pile during the positioning of the pile cap on the top of the pile.

The cross-sectional dimensions of the cover need not be much greater than the size the pile dictates, which, in practice, is considerably less than the cross-section of the hammer unit. Thus the difficulties experienced with the previously known hoods as regards wind influence are substantially avoided.

At its upper end, the cover is preferably closed at its connection with the pile cap or hammer unit, and as the cover is closed along its length and rests at its lower end snugly on the soil, the air within the cover is substantially completely trapped. The sound generated by the pile is transmitted into the trapped air space within the flexible cover, whereby the noise from the pile which is transmitted to the external atmosphere is considerably reduced.

The material from which the cover is made need not possess special sound-absorbing properties. It should have flexible properties in order to reduce the transmission of vibrations from the trapped air inside the cover to the outside air. Conveniently, the cover may be made from a woven fabric, a plastics material, rubber, or a rubberised woven fabric. As the cover is entirely separate from the lead over its full length, the cover can be used in applications where a lead is not employed. The cover maintains its straight form when extended from the pile itself and can therefore be used both with vertical piles and slanting piles. The weight of the construction is minimal and hardly influences the crane capacity.

Noise suppression from the pile can be further reduced by using a double-walled cover arrangement, for example two concentric bellows-like covers; one being arranged inside the other thereby providing trapped air spaces both within the inner cover and between the two covers. More than two cover walls may be used.

According to a feature of the invention, the cover comprises a plurality of superposed rings of flexible material connected together in pairs around their external and internal peripheries, and adjacent rings of adjacent pairs of rings being connected together along a circular line intermediate the external and internal peripheries, and openings being provided between the adjacent pairs to enable air to pass into and out of the annular air spaces between each said pair of rings as the cover is extended and collapsed. To reach the outside atmosphere, sound from the pile must pass through the trapped air immediately surrounding the pile and also through the air trapped in said annular air spaces, as well as through two layers of flexible material. This construction, as will be later more fully described, is simple to make, can be fabricated from thinner flexible material than a simple bellows construction having the same thickness of flexible material between the pile and the outside air thus enables a unitary double walled cover to be retracted to a small length.

Figure 2:
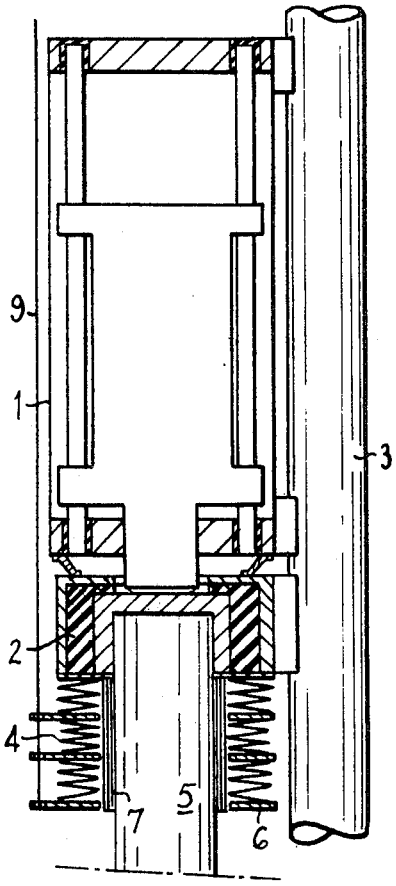
FIG. 2 is a diagrammatic sectional view through the hammer unit and pile cap and cover in the retracted position.
Figure 3:
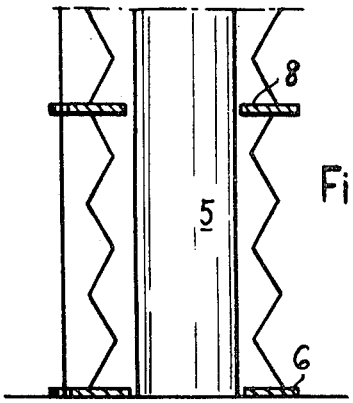
FIG. 3 is a view similar to FIG. 2 with the cover extended.

One construction according to the invention is illustrated in FIGS. 2 and 3. The pile driving apparatus includes a hammer driving unit 1 surmounting a pile cap unit 2 positioned on the upper end of a pile 5.

The hammer unit comprises a hammer 60 which travels along guides 61, 62 within a surrounding housing 63 which may be made of or lined internally or externally with sounddeadening material. The housing 63 is equipped with shoes 69, 70 guided on the lead 3. The ends of the guides 61, 62 are mounted in resilient or shock-absorbing means 64–67 incorporated in the top and bottom walls **63*a* and 63*b* of the housing 63. The resilient means 64, 65 are cup-shaped so as to shield the guides 61, 62 from the outside atmosphere whereas the resilient means 66, 67 are sleeved-shaped since the lower ends of the guides are shielded from the outside atmosphere by means of a circular flexible ring 68 of resilient material, and having a flexible lip portion 68*a*, which supports the housing 63 on the top of the pile cap unit 2. The ring 68 is attached to the bottom of the housing 63 outwardly of the resilient means 66, 67. The flexible lip portion 68*a* projects inwardly from the ring attachment location, tapering in the direction of its free end and being deformed inwardly by the weight of the housing and hammer mechanism so that it outer surface engages the top of the pile cap unit 2. The pile cap unit 2 comprises the pile cap proper 70 which is surrounded by and held captive in an outer casing 71 lined with sound-insulating or resilient material 72 interposed between the pile cap 70 and the casing. The casing 71 has a top wall with an opening through which the hammer can strike the pile cap 70. The pile cap casing 71 has shoes 73 that guide the unit along the lead 3. The flexible lip portion of the ring 68 serves to keep closed the space around this zone by remaining on the casing 71 when the housing 63 and the pile cap unit 2** move apart on impact.

By means of the constructions described, noise from the hammer unit is substantially reduced and the sealing ring 68 reduces direct radiation of sound into the atmosphere from the zone of impact of the hammer on the pile cap. The ring 68 also reduces transference of vibrations of the pile cap to the housing. The insulation 72 surrounding the pile cap 70 reduces direct radiation of sound from the pile cap 70 into the surrounding atmosphere and as the pile cap 70 is indirectly connected to the lead 3 via the resilient material 72 and the casing 71, transmission of vibrations to the lead 3 is also reduced.

While the preferred constructions of the hammer unit and pile cap described reduce the sound radiation from the hammer unit and pile cap, they do not reduce sound radiation from the pile itself. To shield this source of sound, there is secured to the pile cap unit 2 a sound-reducing cover 4 shown as of bellows form to be extendable from a retracted condition, as shown in FIG. 2, to an extended position as shown in FIG. 3 in which it completely encloses the pile 5 to be driven. When extended, the cover has to be the length of the pile which may be of the order of 20 meters and its bottom end is provided with a relatively heavy ring 6, for example 50–60 kilograms in weight, in order to cause the cover to extend when it is released from the retracted position shown in FIG. 2 and to enable the lower end of the cover to rest snugly on the ground and provide a substantially air-tight closure thereat. In its retracted position, the bellows surrounds a skirt 7 projecting from the under-side of the pile cap so as to provide a lead-in for the top of the pile and reduce the risk of damaging the cover during positioning of the pile cap on the pile. The bellows cover may be latched in the retracted position by suitable latching means (not shown). In its retracted position the bellows is preferably compressed into a length of approximately 80 centimetres.

The cross-section of the cover may be circular or of any desired shape to suit the particular pile that it has to surround. The method of using the device according to the invention is diagrammatically illustrated in FIG. 1 in which in position A the hammer unit 1 is in its fully raised position and the bellows 4 is held in its fully retracted condition. The pile 5 can be brought into position and the hammer unit and pile cap lowered so that the top of the pile is positioned in the pile cap as shown at B. The next step, as shown at C, is to lower the bellows until its lower end rests on the ground and the pile is fully enclosed by the bellows. The bellows may be lowered simply by releasing the latch which retains the bellows in the retracted position or by means of cables which may be used for lowering and raising the bellows in the manner hereinafter explained. As the pile is driven into the ground, the cover automatically folds up as shown at D until the pile is driven into the required depth (position E). The bellows is then latched in the retracted position and the hammer unit, pile cap and bellows raised to its initial position as shown at F to enable the next pile to be brought into position in the piledriving rig.

Intermediate support or guide rings or members 8 may be positioned at spaced distances along the interior of the cover in order to guide the bellows along the pile. Such guide rings or members are especially useful in the case where the pile is slanting and not directly upright. These guide rings may be positioned at, for example, spacings of 2 meters along the length of the bellows and may be located between two adjacent folds.

Figure 1:
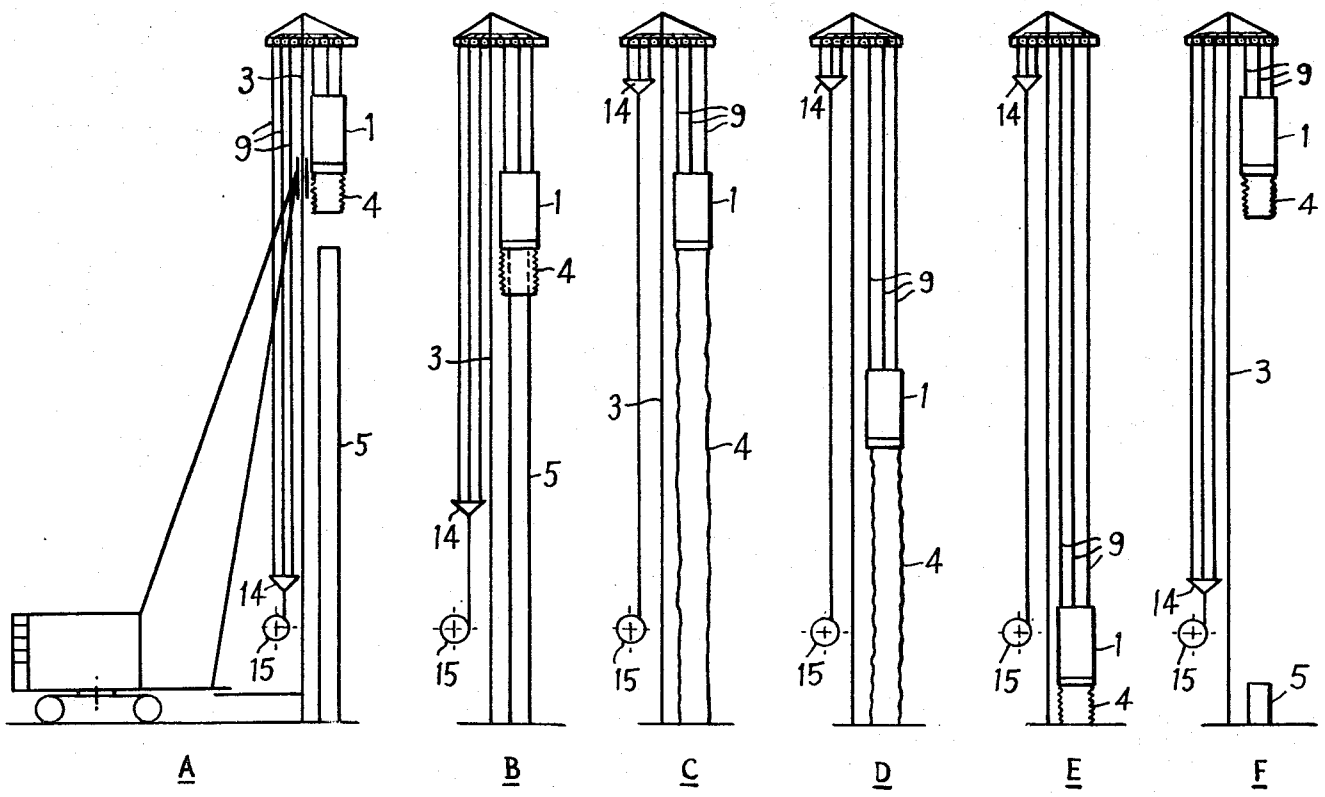
FIG. 1 is a diagram showing the sequence of operations for driving a pile while using the noise-reducing cover according to the present invention.

If desired means may be provided for lowering and hoisting the bellows relative to the hammer unit and pile cap. For example, cables may be disposed at suitable positions around the cover being secured to the lower end of the cover and if necessary guided through guide apertures at intermediate positions along the cover and on the hammer unit. These cables, one being represented at 9 in FIGS. 2 and 3, may be arranged as shown in FIG. 1 to extend over guide means at the top of the lead 3 and connected to a member 14 movable up and down by the mechanism, diagrammatically indicated at 15, which may be hand-driven or mechanically-or hydraulically-powered. The cables may be guided through apertures in the guide rings 8.

Figure 4:
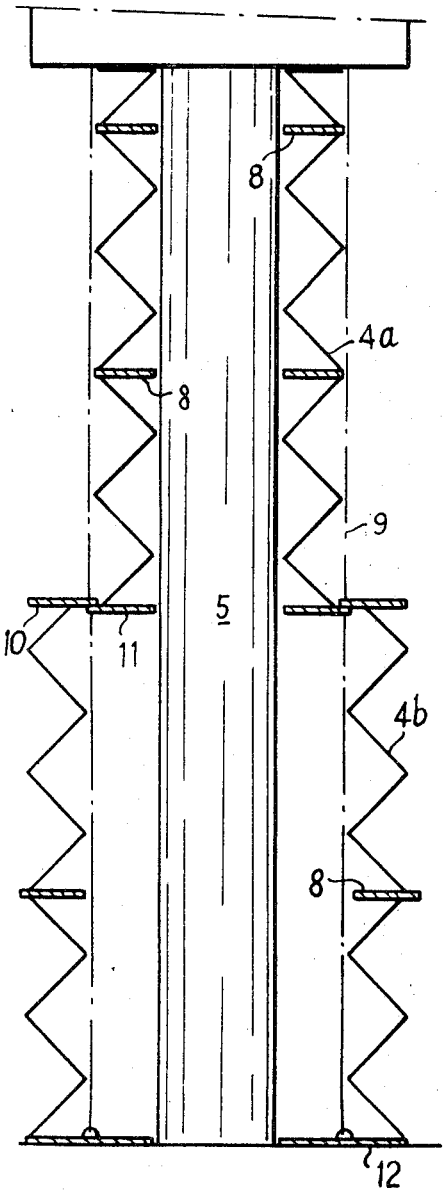
FIG. 4 is a diagrammatic view of another construction of cover according to the invention, the cover being shown in the extended position.
Figure 5:
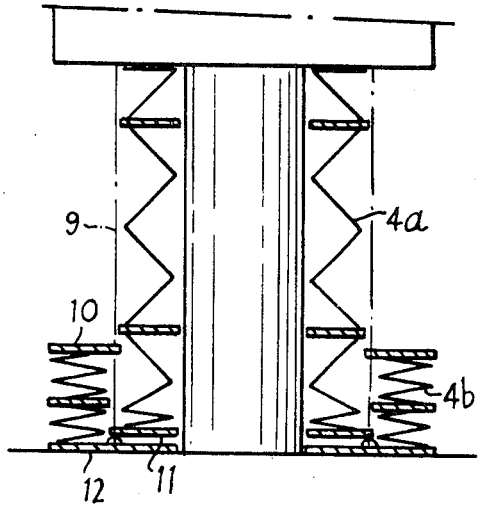
FIG. 5 is a view similar to FIG. 4 with the cover partially retracted.

It will be appreciated that the length of the bellows when extended is dictated by the length of the pile and that the minimum length when the bellows is retracted depends upon the construction and the thickness of the material from which the bellows is made. FIGS. 4 and 5 show a modified construction enabling the minimum length to be reduced by constructing the bellows in two sections 4*a*, 4*b* of approximately equal length and arranged concentrically so that the lower section 4*b* can be folded and collapsed around the upper section 4*a*, as shown in FIG. 5. The top of the lower section is provided with a ring 10, the internal periphery of which rests on the outer periphery of a ring 11 at the bottom end of the section 4*a*. The lower end of the section 4*b* is provided with a ring 12 of smaller internal diameter than the external diameter of the ring 11 so that when the lower section is fully collapsed the ring 12 will bear on the ring 11 to commence collapsing of the upper section 4*a*. Hoisting of the bellows may be effected by wires or cables represented at 9 disposed equiangularly, for example at three positions, around the bellows and secured at one end to the bottom plate 12 being guided at other positions through apertures in the intermediate rings. Support or guide rings 8 may be positioned at space locations inside the bellows sections in a manner similar to that described with reference to FIGS. 2 and 3.

The flexible material used for the construction of the bellows or cover may conveniently comprise a woven fabric, rubber or rubberised fabric such as rubberised woven nylon.

Figure 6:
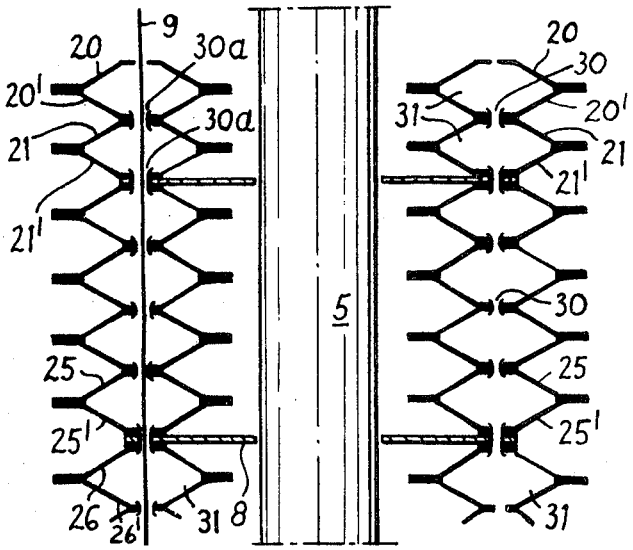
FIG. 6 is a diagrammatic section through another construction of cover shown in the extended position.
Figure 7:
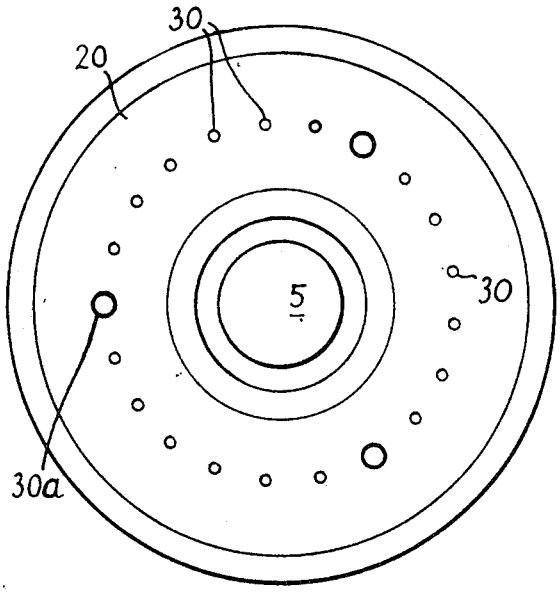
FIG. 7 is a plan view of FIG. 6.
Figure 8:
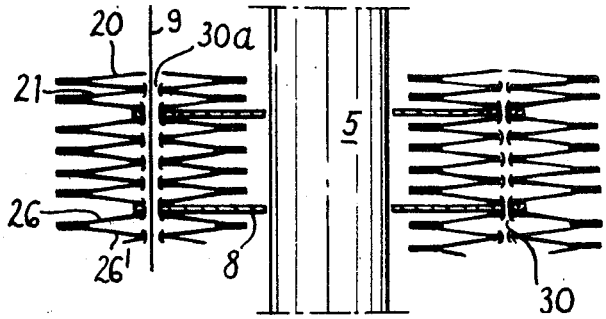
FIG. 8 is a view similar to FIG. 6 with the cover in the retracted condition.

FIGS. 6–8 shown an alternative construction of bellows comprising superposed rings 20, 20′, 21, 21′, etc., of flexible material which are joined together in pairs 20, 20′; 21, 21′; etc., around their inner and outer peripheries, for example by sewing, and of which adjacent rings of adjacent pairs, for example 20′ and 21, are joined together along a circular line intermediate said inner and outer peripheries by eyelets 30 (see FIG. 7), whereby when the bellows is extended, hollow annular spaces 31 are formed between the pairs of rings, said spaces being connected by the passages through the eyelets. Some of the eyelets 30*a* are of larger diameter to enable the hoisting wires or cables 9 to be passed therethrough. At spaced distances along the bellows guide rings 8 are secured to the bellows to serve the same purpose as the rings 8 of FIGS. 2 and 3. FIG. 6 shows the bellows in extended condition and FIG. 8 shows the bellows in the near collapsed condition.

With the embodiment according to FIGS. 6–8, the sound waves from the pile have to pass through two layers of flexible material and the air trapped in the cavities before reaching the outside atmosphere, thereby increasing the noise suppression by, according to preliminary tests, more than twice that of a single layer bellows construction as shown in FIGS. 2 and 3. The embodiment of FIGS. 6–8 enables thinner flexible material to be used while achieving the desired noise suppression. For example the rings may be about 2 mm thick which facilitates minimising the retracted length of the bellows. A practical test with an experimental construction of bellows according to FIGS. 6–8 having an inner diameter of 65 cms and an outer diameter of 115 cms and comprising 11 pairs of rings made of 1.8 mm thick rubberised nylon canvas extended to 130 cms provide a noise reduction of 21 decibels. Especially the higher frequencies were suppressed which is very important in relation to pile driving. The reason for this surprising result is not known but appears to do with the air entrapped within the double bellows construction and the relative stiffness of the bellows when extended. The air inside the cover is also trapped.

Figure 9:
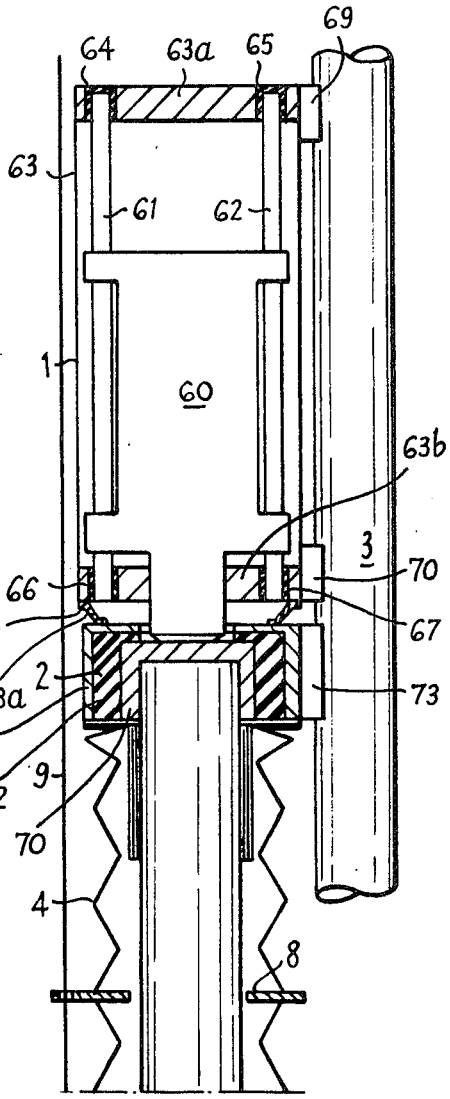
FIGS. 9 and 10 show alternative constructions of cover according to the invention.
Figure 9:
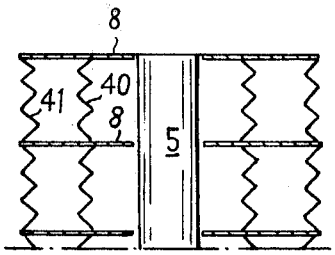

FIG. 9 shows another configuration, which is a combination of two single bellows 40, 41 placed concentrically with an airgap between them. The configuration of FIG. 6 however has advantages over the construction according to FIG. 9 because there are more separated airlocks. The sound insulating properties therefore are better.

Figure 10:
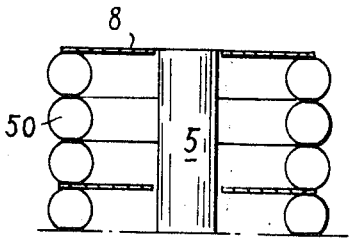

FIG. 10 shows another configuration. Instead of the aforementioned bellows, a large number of circular tubes 50 of flexible material, such as motor car inner tubes, are connected as indicated. When inflated they form a cylindrical wall or air, trapped within the tubes, having considerable stiffness. Of course they should be all pneumatically connected. To avoid an increase of air pressure as the cover collapses with penetration of the pile, the airfilled tubes may be connected to an exhaust equipped with a pressure relief valve so that the pressure always remains within a certain valve and ensures a good airtight connection of the bellows to the soil. At the end of the piledriving operation all tires would be deflated. By applying vacuum to them, the "bellows" can be retracted and hoisted up with the hammer when travelling to its upper position to receive the next pile without any additional mechanical help. They remain retracted on the vacuum. By releasing the vacuum and letting air into the tubes the "bellows" wall around the pile is extended.

I claim:

1. A method of driving a pile into the ground with reduced noise radiation from the pile, comprising the steps of:

a. providing an axially collapsible tubular cover of flexible material attached at one end to a support member selected from a hammer driving unit and a pile cap, b. raising the support member to an elevated position with the cover suspended therefrom retained in a substantially collapsed retracted condition, c. placing the pile in the position where it is to be driven into the ground with its upper end inserted into the open lower end of the cover, d. lowering the lower end of the cover until it reaches the ground and the axially extended cover encloses the pile along its entire length which is above the ground with an air space between the pile and the cover, e. driving the pile into the ground, f. simultaneously lowering the support member during the step of driving the pile to thereby axially collapse the cover as the length of the pile above the ground reduces, and g. when the pile has been driven into the ground to a desired depth, lifting the support member and the at least partially collapsed tubular cover from the top of the pile.

2. A method as claimed in claim 1, which further comprises the step of retaining the cover suspended from the support member in a substantially collapsed retracted condition prior to and during lifting the support member and cover from the top of the pile.

3. Apparatus for carrying out the method claimed in claim 1, comprising a support member selected from a hammer driving unit and a pile cap, an axially collapsible tubular cover of flexible material having internal dimensions sufficient to pass, with an intervening air space, over a pile to be driven and an extended length sufficient to enclose a pile over its entire length, means connecting the cover at one end thereof to the support member and retaining means cooperating with the other end of the cover to retain the cover in a substantially collapsed retracted condition.

4. Apparatus as claimed in claim 3, wherein the cover is formed with a bellow-like or concertina-like construction.

5. Apparatus as claimed in claim 3, wherein said support member includes a protective skirt portion which projects within the cover for a distance approximating the collapsed retracted length of the cover, said skirt portion having internal dimensions sufficient to receive the top of a pile.

6. Apparatus as claimed in claim 3, wherein the cover is made of a flexible material selected from woven fabric, a plastics material, rubber and a rubberised woven fabric.

7. Apparatus as claimed in claim 3, wherein the cover is of multiple-walled construction providing two or more separated air spaces between the pile enclosed by the cover and the atmosphere outside the cover.

8. Apparatus as claimed in claim 3, wherein the cover comprises a plurality of superposed rings of flexible material connected together in pairs around their external and internal peripheries, the adjacent rings of adjacent pairs of rings being connected together along a circular line intermediate their external and internal peripheries, and openings being provided between the adjacent pairs of rings to enable air to pass into and out of the annular air spaces between each said pair of rings as the cover is extended and collapsed.

9. Apparatus as claimed in claim 3, and including guide members positioned at spaced distances along the interior of the cover for guiding the movement of the cover in spaced relation with a pile, and including hoisting cables for hoisting and lowering the lower end of the cover relative to the support member.

10. Apparatus as claimed in claim 3, in combination with a hammer unit including a hammer having a striking head, a housing enclosing said hammer and provided with means defining an opening at its bottom through which said striking head can strike a pile cap, the hammer being supported for guided movement within said housing through the intermediary of resilient means, a casing having a side wall surrounding said pile cap and a top wall defining an opening through which the striking head can strike said pile cap, a layer of sound insulating material between the pile cap and said casing, a ring of flexible material positioned between and engaging said housing and said casing at locations surrounding said openings therein, and means connecting the upper end of the cover to the pile cap.

11. Apparatus as claimed in claim 3, including hoisting cables connected to said other end of the cover, means guiding said cables to move along paths substantially parallel to the axis of the cover, means for moving said cables to collapse the cover to its retracted condition, and weight means at said other end of the cover.

12. Apparatus as claimed in claim 3, wherein said cover comprises at least two sections so dimensioned and arranged that a section in its collapsed retracted condition surrounds another section in its collapsed retracted condition, one of said sections being secured by its upper end to the support member and being provided at its lower end with means preventing the upper end of the next adjacent section from moving below said lower end when said next adjacent section is telescopically extended below said lower end.

13. Apparatus as claimed in claim 3, wherein the cover comprises a plurality of superposed rings of flexible material connected together in pairs around their external and internal peripheries, the adjacent rings of adjacent pairs of rings being connected together along a circular line intermediate their external and internal peripheries, and means defining vent openings in the pairs of rings to enable air to pass into and out of the annular air spaces between each said pair of rings as the cover is extended and collapsed.

14. Apparatus as claimed in claim 8, wherein there are at least two said openings between each adjacent pair of rings, the openings between successive pairs of rings being aligned in the axial direction of the cover, and hoisting cables extend through said openings and connect with the bottom of the cover.

15. Apparatus as claimed in claim 3, and including annular guide members secured at spaced positions along the interior of the cover.

* * * * *